US009463484B2

(12) United States Patent
Foster et al.

(10) Patent No.: US 9,463,484 B2
(45) Date of Patent: Oct. 11, 2016

(54) SPRAY ASSEMBLY FOR SURFACE TREATMENT

(71) Applicant: Crown Beds, Inc., West Plains, MO (US)

(72) Inventors: Gary Henry Foster, West Plains, MO (US); Gary Randall Foster, West Plains, MO (US); Rodney Glendall Foster, West Plains, MO (US)

(73) Assignee: Crown Beds, Inc., West Plains, MO (US)

( * ) Notice: Subject to any disclaimer, the term of this patent is extended or adjusted under 35 U.S.C. 154(b) by 0 days.

(21) Appl. No.: 14/292,223

(22) Filed: May 30, 2014

(65) Prior Publication Data

US 2014/0353394 A1 Dec. 4, 2014

Related U.S. Application Data

(60) Provisional application No. 61/829,314, filed on May 31, 2013.

(51) Int. Cl.

| | |
|---|---|
| ***B05B 1/20*** | (2006.01) |
| ***B05B 15/02*** | (2006.01) |
| ***B05B 13/00*** | (2006.01) |
| *B05B 15/00* | (2006.01) |

(52) U.S. Cl.

CPC ..... *B05B 15/0225* (2013.01); *B05B 13/005* (2013.01); *B05B 15/002* (2013.01)

(58) Field of Classification Search

CPC .. A01M 7/005; A01M 7/0053; A01G 25/09; A01G 25/16; B05B 1/3093; B05B 15/0208; B05B 15/0216; B05B 15/0225

USPC ..... 239/159, 163, 166, 172, 114, 115, 118

See application file for complete search history.

(56) References Cited

U.S. PATENT DOCUMENTS

| | | | | |
|---|---|---|---|---|
| 4,354,624 | A * | 10/1982 | Chowdhury et al. | 222/608 |
| 5,240,502 | A * | 8/1993 | Castaldo et al. | 118/302 |
| 5,957,621 | A | 9/1999 | Clark et al. | |
| 6,719,213 | B1 * | 4/2004 | Ferguson | 239/166 |
| 7,478,765 | B2 * | 1/2009 | Knight | 239/125 |
| 2004/0232261 | A1 * | 11/2004 | Choat et al. | 239/723 |

* cited by examiner

*Primary Examiner* — Davis Hwu

(74) *Attorney, Agent, or Firm* — Scott L. Harper; Griffith Bates Champton & Harper LLP

(57) ABSTRACT

The invention generally relates to a surface treatment distribution apparatus and spray assembly apparatus method capable of applying a variety of surface treatments, for example mastic surface treatments, to a variety of highways, roadways and other asphalt surfaces of variable shapes and sizes. The invention generally includes a tank, pumps, operator station, control inputs, filter assemblies, spray bar and self cleaning spray tip assemblies. Each spray tip assembly includes a self cleaning functionality whereby the operator may remove any debris or clogging material from one or more spray tips with a pneumatically actuated plunger located in the spray tip assembly that acts to force the debris or blockage out of the spray tip. The plunger retracts after actuation and the spray tip assembly is then ready to resume spray operations as desired by the operator.

5 Claims, 8 Drawing Sheets

SPRAY ASSEMBLY FOR SURFACE TREATMENT

CROSS-REFERENCE TO RELATED APPLICATIONS

This application claims the benefit of and priority to U.S. provisional application, Ser. No. 61/829,314, filed on May 31, 2013, the disclosure of which is incorporated herein by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION BY REFERENCE OF MATERIAL SUBMITTED ON A COMPACT DISC

Not Applicable

BACKGROUND OF THE INVENTION

The present invention relates generally to apparatus and methods for applying a surface treatment to roadway surfaces and more specifically to a truck mountable surface treatment distributor apparatus and method providing the operator with control of the application rate of the product in real time as the surface treatment is being applied. The present invention also relates to apparatus and methods for cleaning the applicator spray tips so as to easily maintain the spray apparatus and prevent clogging of the applicator apparatus over repeated usage.

Asphalt surface treatments are applied to asphalt roadways and surfaces mainly as a preventative maintenance procedure to prevent or delay degradation of the road surface from environmental exposure to rain, snow, and thermal temperature variations. Surface treatments are also applied to enhance the wearing properties of the roadway and to improve fraction between the vehicle tires and the roadway.

Generally, asphalt surface treatments are composed of a thin layer of asphalt material made from an asphalt emulsion, cutbacks or asphalt cement. Mastics and/or other modifiers may be added to liquid asphaltic mixture and may include rubber, latex, and polymers. Additional additives such as sand, aggregate, fillers and rubber crumbs may applied after the asphaltic mixture is applied to the pavement surface. In other known sealing methodologies, certain seal coats such as slurry seals, utilize aggregates and fillers that are combined in the seal coat mixture prior to application on the asphalt surface.

Asphalt surface treatments are typically applied by a distributor spray system such as a truck mounted system with multiple spray applicators or "spray tips" attached to a spray bar mounted on the rear of the truck. The fluid or surface treatment to be applied to the roadway is stored on a tank mounted to the truck and drawn from the tank through a pump and into the spray bar and shot or emitted as a spray from the spray tip nozzles in a downward direction and on to the road surface. The spray applicators are in fluid communication with a manifold and the pressure within the manifold is controlled by a control panel so that the operator may control and adjust the rate of fluid application to the road surface. However, in most if not all applications, the application of surface treatments to a roadway surface requires intermittent spraying and actuation of the system due to environmental working conditions or to allow for treatment of certain areas of the roadway. For example, during periods of high winds spraying of a roadway surface may result in the surface treatment being blown out of the desired coverage area or being substantially dispersed in the air. As such, it is not cost effective to continue spraying operations until environmental conditions become more favorable spray operations that can change within minutes. As the truck is on site, yet not conducting spray operations, the surface treatment may which is in a liquid state may begin to congeal and thicken resulting in the formation of agglomerated particles into small chunks of hardened material that can result in the partial stoppage and clogging of the spray system and spray applicators. Also, if the spraying system is not cleaned or flushed soon after spraying operations are stopped or completed, the spraying application system and spray applicators may become clogged which substantially reduces the ability to conduct spray operations until the system and equipment are flushed or cleaned at a maintenance facility.

BRIEF SUMMARY OF THE INVENTION

The invention generally relates to a surface treatment spray system apparatus and method capable of applying a variety of surface treatments, for example mastic surface treatments, to a variety of highways, roadways and other asphalt surfaces of variable shapes and sizes. The invention generally includes a tank mounted on load cells secured to a subframe assembly. The subframe assembly mounts to a standard truck chassis or, in other embodiments, a trailer or other vehicle. The spray system also includes a tank, pumps, operator station, compressed air source, control inputs, primary filter assemblies, secondary filter assemblies, spray bar and self cleaning spray tips in fluid communication via rigid, semi-rigid or flexible piping connections rated for pressurized operations. A global positioning system (GPS) may be integrated with the system to provide accurate speed and distance information associated with the system while in use and calibrated scales for tracking product weight(s) before, during and after operation of the system and to provide weight differential data during operation of the system.

Spray tip assemblies, also referred to herein as spray tips, include a self cleaning functionality whereby the operator may remove any debris or clogging material from one or more spray tips with a pneumatically, or by other pressure induced means, actuated plunger located inside of each spray tip that acts to force debris or other blockage out of the spray tip. The plunger retracts and the spray tip is then ready to resume spray operations as desired by the operator.

BRIEF DESCRIPTION OF THE DRAWINGS

Various other objects, features and attendant advantages of the present invention will become fully appreciated, as the same becomes better understood when considered in conjunction with the accompanying drawings and photographs of the invention.

DETAILED DESCRIPTION OF THE INVENTION

Figure 1:
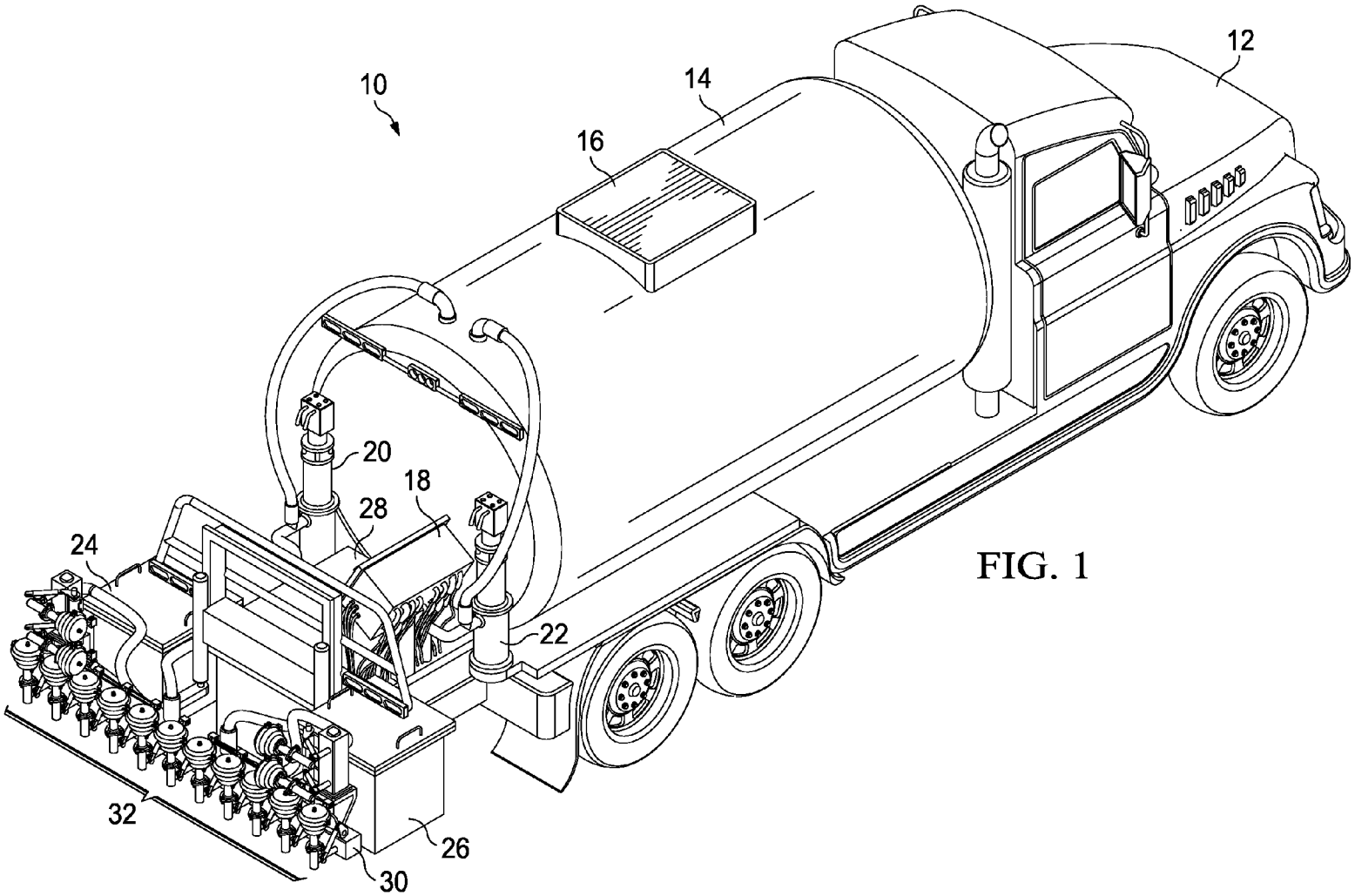
FIG. 1 is a perspective view of a vehicle and spray system incorporating the invention disclosed herein for applying a liquid surface treatment to a roadway.

As described herein and shown in the accompanying Figures, the inventive embodiments described and shown herein disclose an apparatus and method for applying, in one embodiment, an aggregate filled asphalt-emulsion coating designed to add friction and wear surfaces to an existing asphalt surface. As shown in FIG. 1, the spray system 10 is mounted to a truck 12 or other capable vehicle or trailer apparatus and provides operator controlled application rates or "shot" rates of the coating product. In certain applications, the shot rate is typically applied to the asphalt surface at 0.1 gallons per square yard per shot. Additionally, the apparatus and method disclosed herein provide variable shot rate control by the operator in real time during application processes.

The elements of the invention include a tank 14 with a paddle agitator contained therein (not shown) for agitating the mastic emulsion surface treatment or other spray fluid contained in the tank and to keep the spray fluid in suspension while residing in the tank. The tank 14 may be made from steel, plastics or other materials of sufficient strength and durability for use with mastics and other asphaltic sealing materials. A hatch 16 is provided for access to the interior of the tank 14 to allow for filling of the tank 14 or inspection of the tank 14. In one embodiment, the paddle system agitator is hydraulically powered and is capable of being rotated bi-directionally. In an embodiment, the tank 14 is mounted on load cells and secured to a subframe assembly. The load cells transmit measurable electrical data to a scale head that converts the load data transmitted from the load cells to weight measurements enabling the operator to collect and process data related to specific job production as is known in the art. The subframe assembly is mountable to truck 12, such as a Class 8 truck chassis, or any other mobile platform capable of supporting the invention assembly as disclosed herein.

Figure 4:
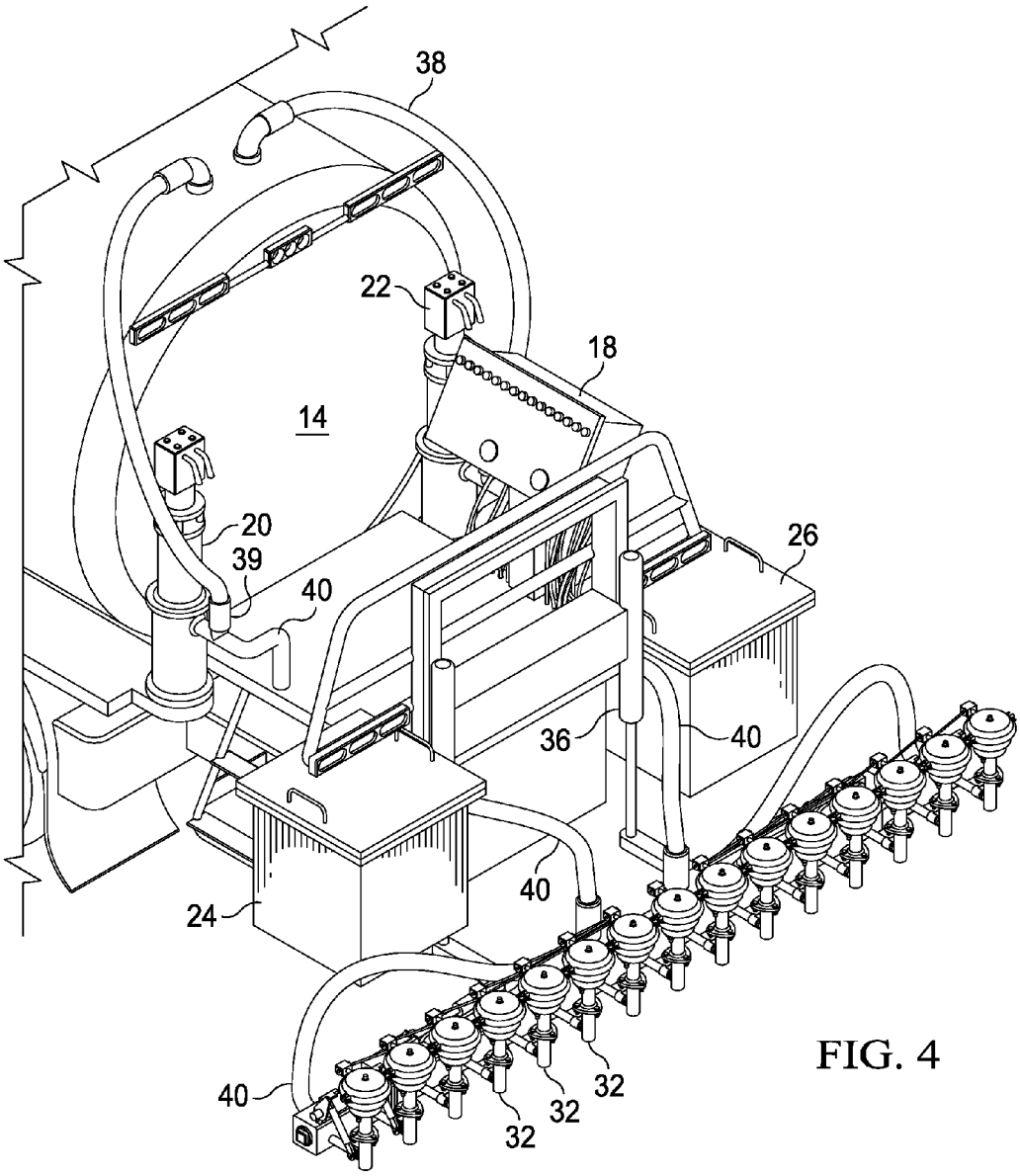
FIG. 4 is a rear perspective view of the vehicle and spray system incorporating the invention disclosed herein depicting the pumps, filters and spray bar with spray tip assemblies.

As shown in FIGS. 1 and 4, a first pump 20 and a second pump 22 comprising in one embodiment single acting piston/plunger pumps capable of producing a flow rate of up to 100 gallons per minute are in fluid communication with the tank 14 via hydraulic piping and hoses providing a fluid communication system to the elements of the invention disclosed herein. The first and second pump units 20,22 provide sufficient pumping force to pressurize, transport and dispense the spray fluid contained in the tank 14 throughout the fluid communication system connecting the tank 14, pumps 20, 22, filtration assemblies 24, 26, spray bar 30, and self-cleaning spray tips 32 at the rates and pressures desired by the operator and controlled by the operator stationed (sitting or standing) on platform 28 from control panel 18 for determining the shot rate for application of the fluid surface treatment to the pavement surface. The spray fluid communication system (including but not limited to hosing 40, spray bar 30, spray feed tubes 31 and recirculation hoses 38) provides the pathways for the flow of fluids through the system utilizing sufficient pressure rated hosing and/or metal piping as is known in the art. Although not shown in detail, one of ordinary skill in the art may easily configure the pneumatic and/or hydraulic components and communication system necessary to supply and operate the identified pneumatic and hydraulic components of spray system 10 as described hereinafter.

A primary filter assembly 24 is in fluid communication with the tank 14 and first pump 20 which provides fluid from tank 14 to primary filter assembly 24 so as to filter out agglomerated clumps or off-size materials suspended in the mastic fluid which might clog, degrade or otherwise inhibit operation of the fluid communication system, pumps 20, 22 or one or more spray tips 32 located on the spray bar 30. One or more secondary filter assemblies 26 are positioned downstream of the first pump 20 and upstream of the spray bar 30 and spray tips 32. The secondary filter assembly 26 acts to remove suspended particles in the fluid which are of sizes small enough to pass through the primary filter assembly 24 and such particles remaining of sizes sufficient to clog or inhibit the flow of fluid (e.g. mastic) to and through the spray bar 30 and spray tips 32 located thereon.

In certain contemplated embodiments, the first pump 20 and primary filter assembly 24 provide fluid to the spray bar 30 with second pump 22 and secondary filter assembly 26 remaining offline as a backup system for providing fluid to spray bar 30. In certain contemplated embodiments, pumps 20, 22 and filter assemblies 24, 26 may operate as separate systems for providing fluid to the spray bar 30 in a series or parallel fluid communication system design. It is contemplated that the pumps 20, 22 and filter assemblies 24, 26 may be interconnected as desired by the user or as dictated by the application to provide and filter spray fluid to the spray bar 30 and spray tips 32 in a parallel or series fluid communication system from which spray fluid is pumped from tank 14 and ultimately to spray tip assemblies 32 via spray bar 30. One of ordinary skill in the art will recognize the various fluid communication pathways and networks which may be utilized with the apparatus and method disclosed herein and any particular network described herein is not to be construed as a limitation to any such other contemplated embodiments.

The primary and secondary filter assemblies 24, 26 generally comprise a closeable box enclosure with a screen basket filter contained therein providing for pressure filtration of the fluid that is being pumped out of the tank 14 and through to the spay bar 30 and spray tips 32 for spraying on to a roadway surface. In one embodiment, the sieve size of the primary screen filter element is about ⅜ inches, while the sieve size of the secondary screen filter element is about 3/16 inches. In one embodiment, the screen size of the primary screen filter element is larger than the sieve screen size of the secondary screen filter element. The sieve size of the primary and secondary screen filter elements 24, 26 may be sized according to the fluid being applied to the pavement surface and the particle types and sizes suspended in the fluid. The lids of the primary and secondary filter assemblies 24, 26 are removable to facilitate removal and replacement of the filter screens for cleaning and maintenance.

A spray fluid recirculation circuit is also provided to provide for circulation of the spray fluid while spraying operations have temporarily been stopped. First pump 20 and second pump 22 draw spray fluid from tank 14 into hosing 40 for provision to the spray bar 30 and ultimately to spray tips 32 for deposit on to the roadway. When spraying operations are temporarily stopped, the operator who is located on the operator platform 28 may configure the system 10 via control panel 18 to remain pressurized and recirculate spray fluid drawn from the tank and through pump 20 and/or pump 22 to return spray fluid into tank 14 via valves 39 that direct the fluid flow to the recirculation hosing 38 from pump 20 and/or pump 22 and back into tank 14. In this manner, the spray fluid remains moving and pressurized in the system and such recirculation acts to inhibit coagulation or formation of hardened spray fluid nodules from forming when spraying operations are temporarily ceased. Likewise, the system remains in a pressurized state and when spraying operations are to be resumed the operator actuates valves 39 to direct spray fluid to the spray bar 30 via hoses 40. In an embodiment, spray fluid in spray bar 30 is also in fluid communication with pump 20 and/or pump 22 and is recirculated to tank 14 via the fluid communication system.

After spraying operations are complete, the operator may flush and clean the fluid communication system, pumps, filter assemblies and spray tips by pumping water (or other cleaning solvents or fluids as may be desired) from a storage tank (not shown), which is located on the truck 12 or from another external source, through the fluid communication system for rinsing and cleaning the piping and hoses, valves, pumps, filters and spray tips of the spray system 10. This prevents any remaining spray fluid from drying out and hardening within the equipment components and fluid communication system that would degrade or inhibit the operation and performance of the invention disclosed herein.

Figure 2A:
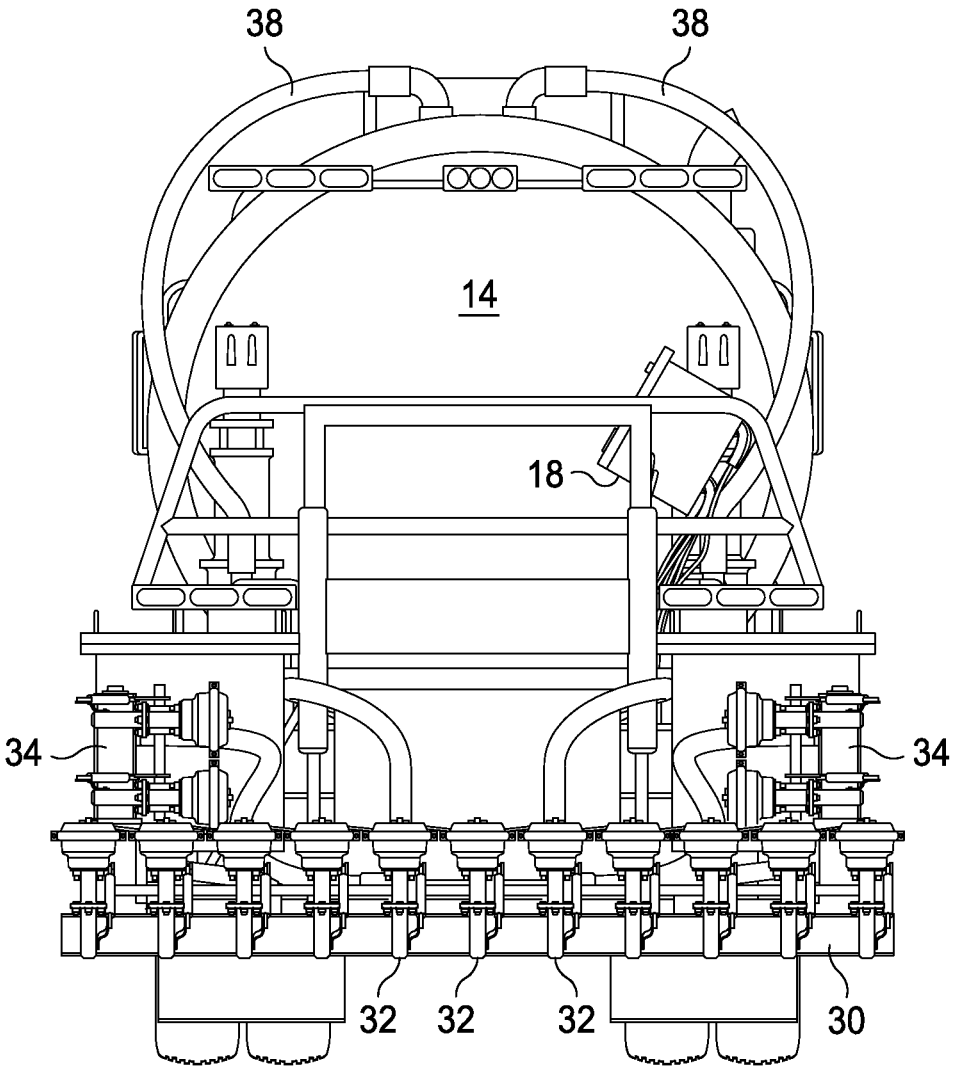
FIGS. 2A and 2B is a rear view of the vehicle and spray system incorporating the invention disclosed herein with spray bar extensions folded and unfolded, respectively, for additional coverage operations.
Figure 2B:
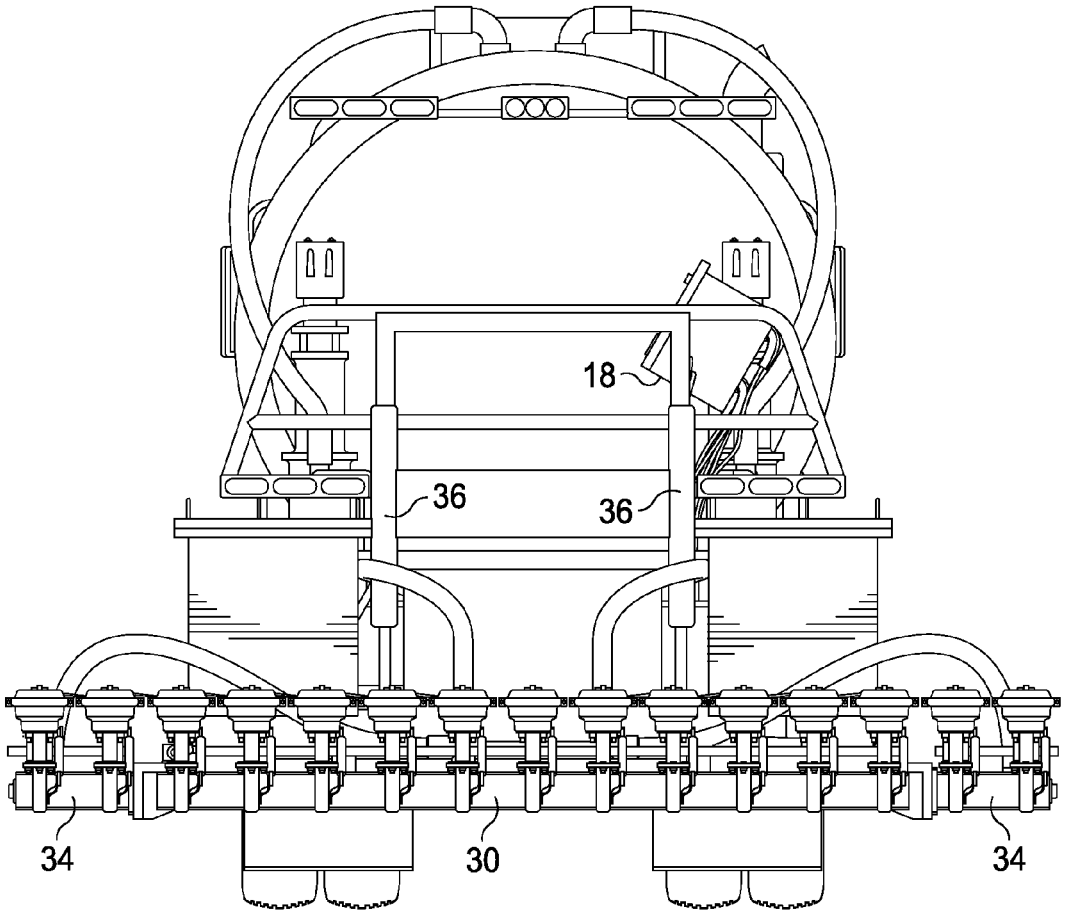
Figure 3:
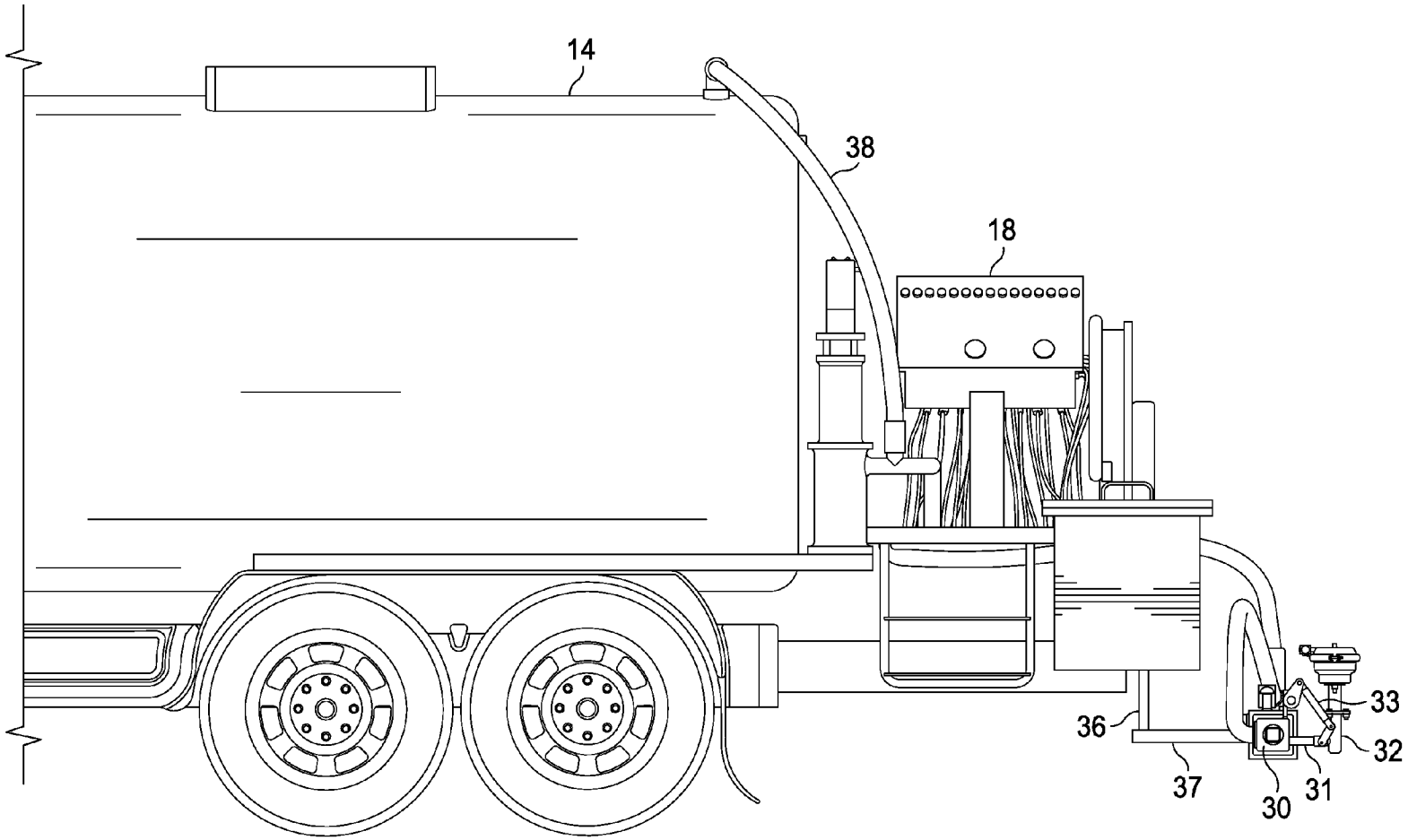
FIG. 3 is a side view of the vehicle and spray system incorporating the invention disclosed herein.

As shown in FIGS. 2A, 2B and 3, spray bar 30 includes folding spray bar extensions 34, 36 which are in fluid communication with the tank 14, pumps 20, 22 and filter assemblies 24, 26. Spray bar 30 includes multiple spray tips 32 attached to the spray bar 30 by spray feed tubes 31. Spray tips 32 emit and direct the spray fluid or other desired fluid on to an asphalt pavement or roadway surface as further described herein. As seen in FIG. 3, spray tips 32 receive fluid to be sprayed on to the roadway from spray feed tubes 31 which provide fluid communication between the spray bar 30 and lower chamber of each spray tip 32 (shown and described in FIGS. 4 and 5). A spray feed tube valve (not shown) is included with each individual spray feed tube 31 and positioned between the spray bar 30 and each spray tip 32. The spray feed tube valves are actuated (either opened or closed) by valve actuator 33 that is controlled hydraulically, pneumatically, electronically or by other means as known in the art by the operator from control panel 18. Spray feed tubes 31 are secured to the spray bar 30 and spray tips 32 at nipple 72 as shown in FIGS. 6A and 6B located on the lower chamber 64 depicted in FIG. 5 for ease of maintenance and replacement as needed. In an embodiment, spray feed tubes 31 are welded to spray bar 30 so as to provide a stable and rigid support for spray tips 32. In other contemplated embodiments, spray tips 32 may be supported and connected to spray bar 30 by other means as known in the art such as rigid frames, extension arms or supports connected to spray bar 30 and to which spray tips 32 are secured.

When spray system 10 is pressurized and ready for operation, the desired fluid supply valves (not shown) which are located in each spray feed tube 31 are opened by the operator as described above allowing spray fluid to be emitted from each corresponding spray tip 32 and sprayed on to the roadway surface. When in the closed position, the supply valves prevent the emission of spray fluid from the spray tips 32. In one embodiment, spray bar 30 is about eight feet in length with multiple spray tips 32 fed by individual spray feed tubes 31 spaced about 9.25 inches apart on the spray bar providing for the inclusion of eleven spray tips 32. It is contemplated that various dimensions of spray bar length may be sized and manufactured for various applications and the dimensions provided herein are not to be construed as limiting.

As seen in FIG. 2A, two spray bar extensions 34 are shown in a retracted or folded up position. FIG. 2B shows the spray bar extensions 34 folded down in the ready position for spray operations to commence. Spray bar extensions 34 are rotatably attached to and in fluid communication with the spray bar 30 via hosing 40 (see FIG. 4) allowing the operator to use one or both of the spray bar extensions 34 to extend the width of spray coverage to be deposited on to the pavement surface. The height of the spray bar 30 above the roadway surface is adjustable from between about sixteen to twenty-four inches from the ground via hydraulic or pneumatic cylinders 36 which are connected to spray bar 30 via frame 37 and which act to elevate or lower the spray bar 30 as desired by the operator from control panel 18. In one embodiment, spray bar extensions 34 are hingedly connected to the spray bar 30 so as to allow the spray extensions 34 to be folded up or down via as desired by the operator from the control panel 18 for the task at hand. Folding spray bar extensions 34 provide for the ability to vary the width and/or length of the spray pattern as the pavement surface to be sprayed may vary in width and/or length.

Figure 5:
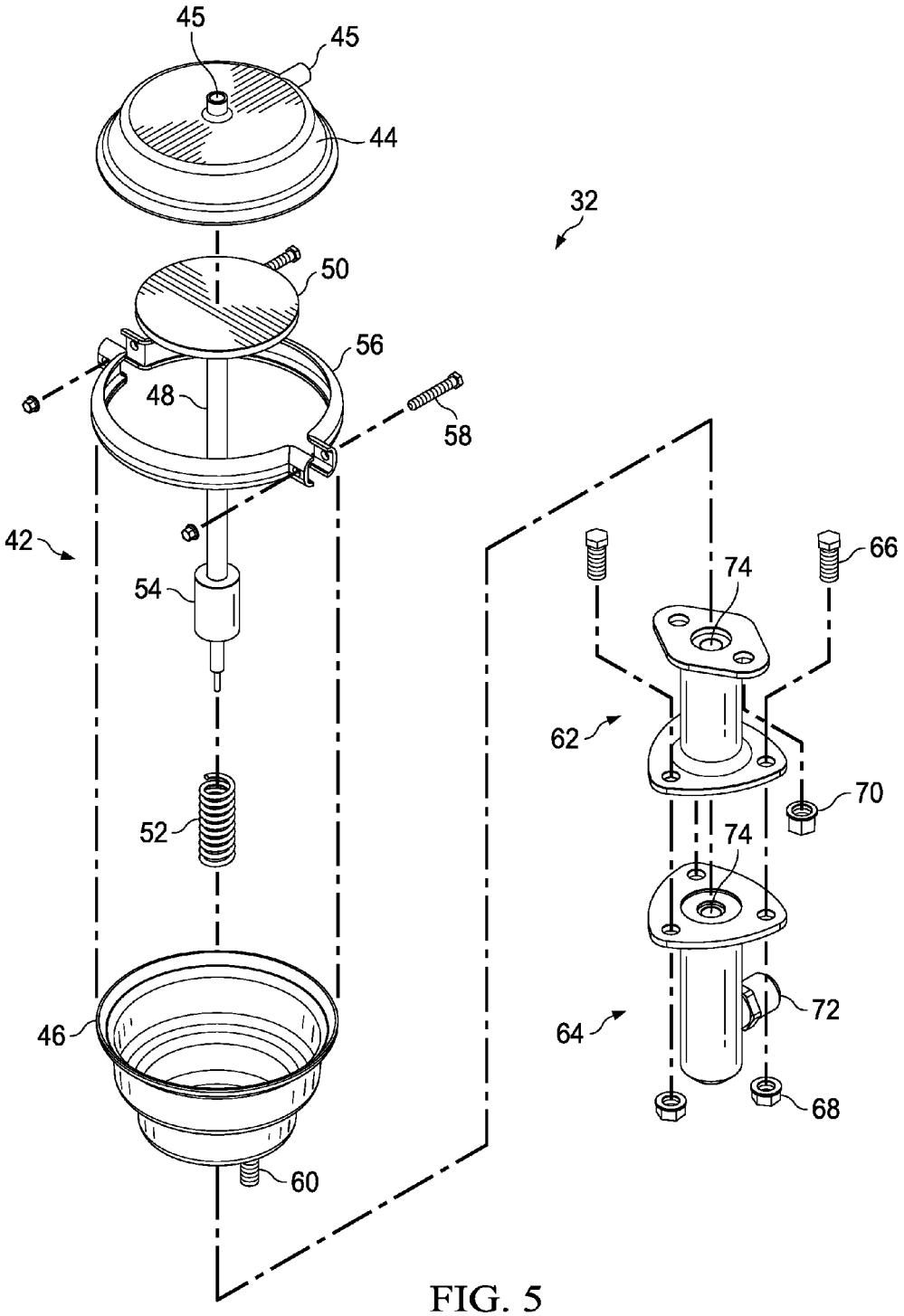
FIG. 5 is an exploded view of a spray tip assembly depicting the components of the spray tip assembly according to the invention disclosed herein; and, FIGS. 6A and 6B are depictions of the lower guide assembly of the spray tip assembly and the self-cleaning mechanism for each spray tip assembly according to the invention disclosed herein.
Figure 6A:
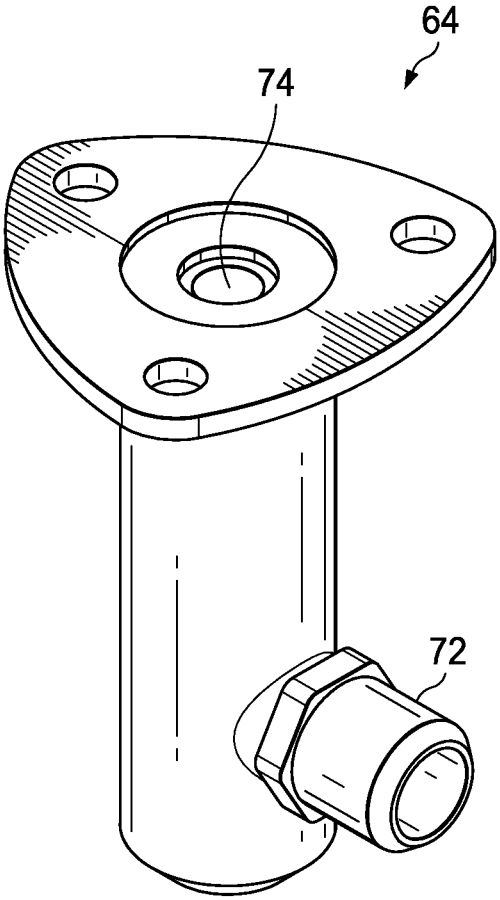
Figure 6B:
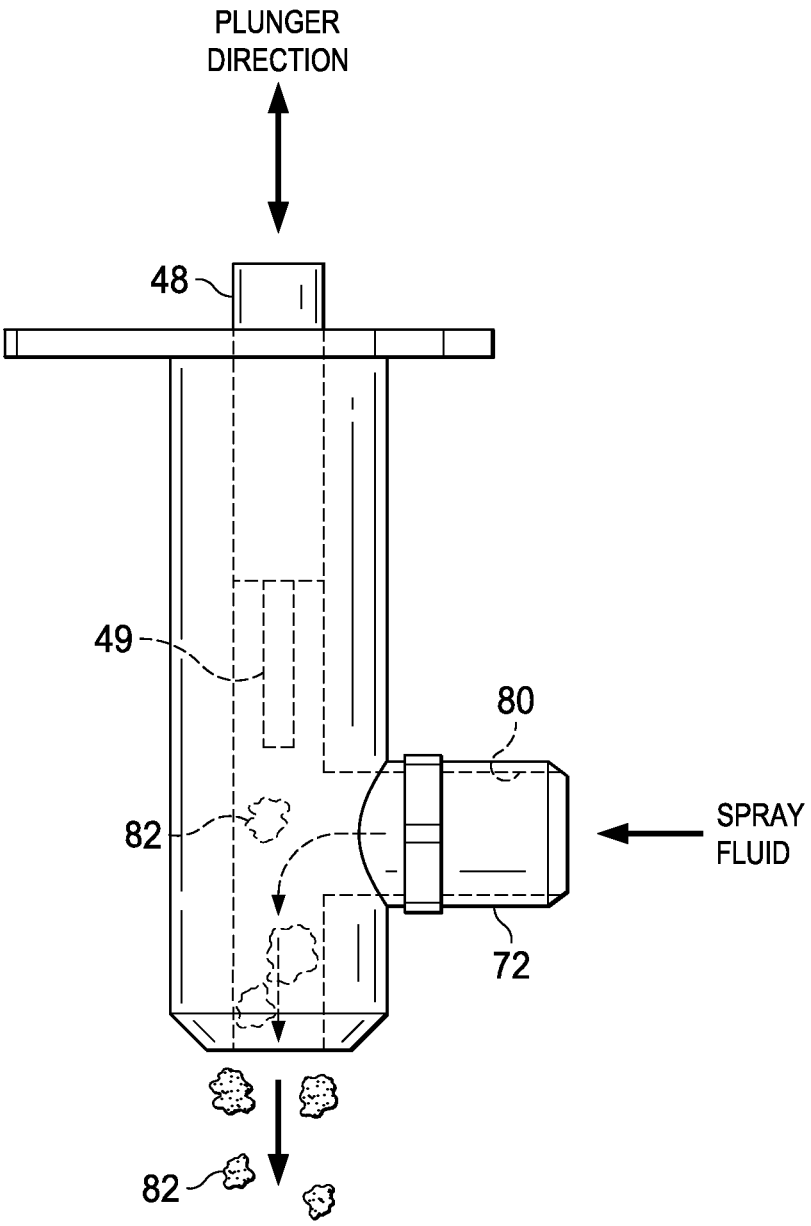

Turning to FIGS. 5 and 6A-6B, the components of spray tip assemblies 32 are shown in greater detail. Each spray tip assembly 32 includes a self-cleaning mechanism whereby any aggregate or other agglomeration of particles and debris in the mastic spray or fluid which act to clog the lower chamber of spray tip 32 may be removed by the actuation of a plunger 48 which acts to force the blocking debris 82 out of the lower chamber of spray tip assembly 32. As shown in FIG. 5, spray tip assembly 32 includes an upper chamber assembly 42, middle guide assembly 62 and lower assembly 64. Upper chamber assembly 42 operates to provide an enclosure for imparting a force generated by pressurizing the upper chamber assembly 42 pneumatically with compressed air (received from a compressed air source in communication with upper chamber assembly 42) entering upper chamber assembly 42 via an air port 45 with enough force imparted by an air diaphragm (not shown) on to plunger disc 50 of plunger 48 that drives plunger 48 downwards, and partially through and out of the spray tip assembly 32 to remove any debris 82 clogging and inhibiting or otherwise preventing the flow of fluid from the spray tip assembly 32. When the pressurization of upper chamber assembly 42 is released and it proceeds back to a rest or atmospheric pressure state from an exhaust valve (not shown) located in one of the air ports 45, plunger 48 retracts due to the force imparted by spring 52 kept in tension by spring tension spacer 54. Plunger tip 49 retracts above the fluid inlet orifice 80 (the plunger tip 49 retracts above the orifice 80 provided in nipple 72) which is in fluid connection with spray feed tube 31 (shown in FIG. 2C) that provides the spray fluid to be sprayed by spray tip assemblies 32. Plunger 48 may be actuated to extend and retract on an as needed basis by the operator or may be programmed to cycle at certain periods as desired by the operator. Upper chamber assembly 42 includes a top housing 44 with air ports 45 providing for the inlet and outlet of pressurized air for imparting a force to plunger 48 via an air diaphragm housed within the upper chamber assembly 42.

Bottom housing 46 is releasably connected and sealed with a gasket (not shown) to top housing 44 with clamp 56 which is tightened/loosened with bolt or screw and nut connectors 58. Such design enables the user to easily access, maintain and repair the upper chamber assembly 42. Top housing 44 and bottom housing 46 may be fabricated from any material suitable for rugged environmental operations including stainless steel and other suitable metals and materials as known in the art. One or more threaded studs 60 are provided on the bottom surface of bottom housing 46 which allow for middle guide assembly 62 to be attached to the bottom housing 46 with nut connectors 70. Bottom housing 46 includes an orifice of sufficient diameter (not shown) and positioned to align with orifice 74 in middle guide assembly 62 and through which plunger 48 may extend and move in the axial direction through corresponding orifices 74 in the middle guide assembly 62 and lower chamber 64 as shown in FIGS. 5 and 6B.

Middle guide assembly 62 is a machined metal component that acts to connect the upper chamber assembly 42 with the lower assembly 64 which includes a machined tubular barrel or orifice 74 through which plunger 48 moves in a bi-directional axial fashion to push debris 82 out of lower chamber 64 as seen in FIGS. 5 and 6B. In certain applications, middle guide assembly 62 may be manufactured from any material suitable for rugged environmental operations including stainless steel and other suitable metals and materials as known in the art. Middle guide assembly 62 attaches to the upper chamber assembly 42 via threaded connection at studs 60 and nuts 70. In an embodiment, lower chamber 64 consists of a machined metal component that includes an o-ring (not shown) that is compressed between the middle guide assembly 62 and lower chamber 64 when bolts 66 and nuts 68 are tightened to connect the middle guide assembly 62 and lower chamber 64 together. The O-ring seal acts to prevent the spray fluid from entering into the upper chamber assembly 42 and middle guide assembly 62. As shown in FIG. 6A, lower chamber 64 includes a nipple 72, such as in one embodiment a #12 JIC 37 degree threaded flare nipple, that provides an attachment point for spray tip assembly 32 to the spray bar 30 via spray feed tube 31 (which can be a rigid or flexible pipe or hose) which includes fluid supply valve 31, and provides a fluid pathway for feeding the spray fluid from the spray bar 30 to lower chamber 64 for dispersion on to the roadway or pavement. In one embodiment, a steel spray tip (not shown) may be threaded into the bottom of lower chamber 64 which provides a degree of interchangeablity so that a user may install different spray tips which provide a different spray pattern as desired. In certain applications, lower chamber 64 may be manufactured from any material suitable for rugged environmental operations including stainless steel and other suitable metals and materials as known in the art.

Operator's control station 18 includes the controls and electronics necessary to operate the inventive apparatus described herein. The operator's control station 18 includes hydraulic, electric, and pneumatic controls for operation of the spray system 10 described above. In an embodiment, the hydraulic controls operate the position of the spray bar (up and down), the agitator in the tank (forward/reverse direction), the water pump (on/off), the first and second fluid pumps (on/off), actuation of the valves in the spray feed tubes controlling the flow of spray fluid from the spray bar to the spray tip assemblies and the pressure valves for the first and second pumps. The electric controls operate the first and second pumps, the air compressor source, and the work lights stationed on and around the operator's station and vehicle. The pneumatic controls are utilized for actuating the spray tip cleaning operation as described herein.

The terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicated. Any headings utilized within the description are for convenience only and have no legal or limiting effect.

We claim:

1. An apparatus, comprising:

a tank with an internal agitator for storing and mixing a spray fluid;

a first pump in fluid communication with the tank wherein the first pump provides for pumping the spray fluid from the tank and through the fluid communication system;

a primary filter assembly in fluid communication with the first pump;

a spray bar in fluid communication with the primary filter; and, at least one spray tip assembly in fluid communication with the spray bar for directing the spray fluid on to a roadway surface wherein the spray tip assembly includes therein an internally disposed plunger for dislodging debris from the spray tip assembly, wherein the spray tip assembly further comprises an upper chamber assembly with an air port in fluid communication with a pneumatic air source, an air port including an exhaust valve and provides a housing for a plunger disc attached to the plunger.

2. The apparatus of claim 1 wherein the spray tip assembly further comprises a middle guide assembly attached to the upper chamber assembly.

3. The apparatus of claim 2 wherein the spray tip assembly includes a lower chamber attached to the middle guide assembly.

4. A spray tip assembly, comprising:

an upper chamber assembly including a plunger disc housed therein with a plunger extending vertically away from the plunger disc and out of the upper chamber assembly;

a middle guide assembly attached to the upper chamber assembly wherein the middle guide assembly includes an orifice extending axially through the length of the middle guide assembly and is adapted to receive a length of the plunger which extends through the middle guide assembly; and, a lower assembly with a nipple wherein the lower assembly is connected to the middle guide assembly, wherein the lower assembly includes an orifice extending axially through the length of the lower assembly and is adapted to receive a length of the plunger so that the tip of the plunger rests at a level above the nipple during the emission of a spray fluid from the lower assembly.

5. The spray tip assembly of claim 4 wherein the application of compressed air into the upper chamber assembly causes the plunger to extend through the orifice below the nipple and dislodge debris from the lower assembly.

* * * * *